US007758975B2

(12) United States Patent
Schier

(10) Patent No.: US 7,758,975 B2
(45) Date of Patent: Jul. 20, 2010

(54) COATING FOR A CUTTING TOOL AND CORRESPONDING PRODUCTION METHOD

(75) Inventor: Veit Schier, Leinfelden (DE)

(73) Assignee: Walter AG, Tubingen (DE)

( * ) Notice: Subject to any disclaimer, the term of this patent is extended or adjusted under 35 U.S.C. 154(b) by 499 days.

(21) Appl. No.: 10/589,855

(22) PCT Filed: Feb. 17, 2005

(86) PCT No.: PCT/EP2005/001584

§ 371 (c)(1),
(2), (4) Date: May 4, 2007

(87) PCT Pub. No.: WO2005/085499

PCT Pub. Date: Sep. 15, 2005

(65) Prior Publication Data

US 2008/0028684 A1 Feb. 7, 2008

(30) Foreign Application Priority Data

Mar. 3, 2004 (DE) ..... 10 2004 010 285

(51) Int. Cl.
*C23C 4/06* (2006.01)

(52) U.S. Cl. ..... 428/698; 51/307; 51/309; 204/192.1; 407/119; 427/331; 427/348; 428/156; 428/212; 428/699; 428/701; 428/702

(58) Field of Classification Search ..... 51/307, 51/309; 428/156, 212, 408, 472, 698, 699, 428/701, 702, 704; 407/119; 204/192.1; 427/331, 348

See application file for complete search history.

(56) References Cited

U.S. PATENT DOCUMENTS

| | | | | |
|---|---|---|---|---|
| 4,746,563 | A * | 5/1988 | Nakano et al. | 428/702 |
| 5,246,787 | A * | 9/1993 | Schulz et al. | 428/469 |
| 5,786,069 | A * | 7/1998 | Ljungberg et al. | 428/212 |
| 5,861,210 | A * | 1/1999 | Lenander et al. | 428/698 |
| 5,871,850 | A * | 2/1999 | Moriguchi et al. | 428/701 |
| 6,342,291 | B1 * | 1/2002 | Jonsson et al. | 428/698 |
| 6,379,798 | B1 * | 4/2002 | Yazaki | 428/408 |
| 6,623,850 | B2 * | 9/2003 | Kukino et al. | 428/699 |
| 6,682,274 | B2 * | 1/2004 | Votsch et al. | 407/118 |
| 6,869,334 | B1 * | 3/2005 | Leyendecker et al. | 451/38 |
| 6,884,497 | B2 * | 4/2005 | Sulin et al. | 51/309 |
| 7,153,562 | B2 * | 12/2006 | Rodmar et al. | 51/307 |

(Continued)

FOREIGN PATENT DOCUMENTS

DE 696 16 810 3/1997

(Continued)

OTHER PUBLICATIONS

German Office Action dated May 23, 2007 cited in co-pending German Application.

*Primary Examiner*—A. A. Turner
(74) *Attorney, Agent, or Firm*—Drinker Biddle & Reath LLP

(57) ABSTRACT

A coating, particularly for cutting tools, is presented which may be manufactured in a single PVD coating process allowing the making of two-color cutting tools in a simple manner. Between two metallic hard material layers of unlike color a separating layer 11 is provided which, like the other layers, is produced in the same PVD coating process. The separating layer (11) permits the abrasion of the top layer by sandblasting, brushing or the like in very short abrading periods.

20 Claims, 2 Drawing Sheets

U.S. PATENT DOCUMENTS

Figure 1:
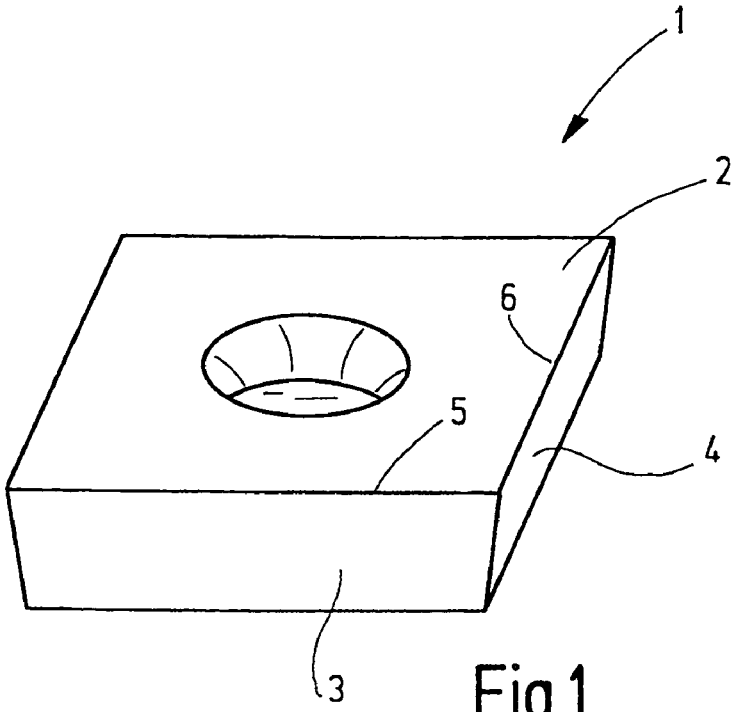

| | | | | |
|---|---|---|---|---|
| 7,163,735 | B2 * | 1/2007 | Ruppi | 428/701 |
| 2002/0039521 | A1 | 4/2002 | Votsch et al. | 407/118 |

FOREIGN PATENT DOCUMENTS

| | | | |
|---|---|---|---|
| DE | 199 33 230 | | 10/2000 |
| DE | 100 48 899 | | 4/2002 |
| EP | 0 413 853 | | 2/1991 |
| EP | 0 430 872 | | 6/1991 |
| EP | 0 553 943 | A1 | 8/1993 |
| EP | 0 732 423 | | 9/1996 |
| EP | 1 094 132 | | 4/2001 |
| EP | 1 195 452 | | 4/2002 |

* cited by examiner

COATING FOR A CUTTING TOOL AND CORRESPONDING PRODUCTION METHOD

The invention relates to a coating adapted particularly for a cutting tool, a cutting tool provided with such a coating, as well as a manufacturing method for making the coating.

Cutting tools are regularly provided with coatings for increasing their chip-removing efficiency, for extending their service life or for other reasons for obtaining the desired properties. For example, DE 100 48 899 A1 discloses a cutting tool as a cutting insert which has a wear-reducing coating which is constituted, for example, by an $Al_2O_3$ layer. The wear-reducing coating extends over the rake surfaces as well as over the clearance surfaces of the cutting tool. On the clearance surfaces an indicator coating is provided, for example, as a top layer, whose color significantly differs from the color of the wear-protection layer. The abrasion of the decorative layer occurring at the clearance surfaces is thus a reliable indication of a performed use of the respective adjoining cutting edge. The layers are produced in a full-surface manner in a CVD process, while the decorating layer is abraded from the rake surfaces. This may be effected by a brushing process or the like. In the mechanical removal of the decorating layer from the rake surfaces care has to be taken to achieve a good selectivity. Damages to the wear-protection layer are not acceptable.

As a rule, cutting inserts made by a PVD process have a metallic layer of hard material, such as a TiAlN layer. Such a cutting insert is known, for example, from DE 199 24 422 C2. Top layers, such as $TiB_2$ layers or the like applied to the wear-protection layer have, as the latter, a metallic-crystalline structure. The adhesion between such top layers and the wear-protection layer is substantial. The tribological properties of the top layers have to be therefore taken into consideration if used as decorative layers. Also, they are not adapted as wear indicators.

Because of the firm adhesion of the layers to one another, the top layer has to possess properties coordinated with the exposure to wear, with its frictional properties and other properties having an effect during metal chip forming.

It is therefore the object of the invention to provide a coating which may be made with a PVD process and which has a top layer adapted to serve as a wear indicator.

The coating according to the invention comprises, as a wear-protection layer, a metallic hard material layer which is covered at the outside by a top layer. The latter has a reduced adhesion to the wear-protection layer or has, by means of a separating layer, a limited adhesion to the wear-protection layer. The top layer covers only one part of the surface of the metallic hard material layer, that is, parts of the latter are exposed. Between the top layer and the metallic hard material layer a separating layer is disposed which disrupts or weakens the metallic-crystalline bond between the top layer and the wear-protection layer. The separating layer is thus a layer which interferes with or reduces the adhesion and disrupts or at least disturbs the metallic-crystalline structure of the other layers.

The separating layer reduces to a small value the adhesion of the top layer on the metallic hard material layer serving as a wear-protection layer. The adhesion is preferably weak to such an extent that itself or a superposed layer is abraded as soon as the cutting tool is used in its intended operation and performs a chip-forming process. Dependent on the mode of application, the abrasion may occur over the full surface or may be localized. In this manner the top layer may be relatively easily abraded. This permits to design the top layer purely from an aesthetic point of view as a decorative layer, and the tribological properties as well as the wear properties play no role: the top layer will be abraded as soon as the cutting tool is put into operation. In this manner the possibility is also provided to use the top layer as the wear indicating layer. This applies particularly if the metallic hard material layer serving as the wear-protection layer and the top layer significantly differ in color.

Thus, the coating of the cutting tool comprises a wear-protection layer having a metallic-crystalline structure, a top layer having a limited adhesion to the wear-protection layer and/or a separating layer applied at least to a portion of the wear-protection layer and disposed between the wear-protection layer and the top layer for limiting the adhesion of the top layer to the wear-protection layer. By a layer having a metallic-crystalline structure there is meant in this context a layer which has a preponderantly metallic bond. Such is the case, for example, in TiAlCN layers, AlCrN layers, TiC layers or the like.

The wear-protection layer is a layer preferably made in a PVD process; the separating layer and the top layer too, are produced in the PVD process, making possible the manufacture of the coating in a single PVD coating step. The top layer, preferably including the separating layer, is abraded in a mechanical post-processing step. The post-processing operation may be performed by brushing, sandblasting or the like. By virtue of the separating layer, the abrading periods may last less than a few seconds. For example, by sandblasting with aluminum oxide (high-grade corundum) at a pressure of only one bar and during a blasting period of only two seconds, such a complete abrading of a TiN top layer of, for example, 0.2 μm is obtained that even at a ten-fold magnification of the upper surface, no residues of the top layer can be optically recognized. The wear-protection layer (metallic hard material layer) is barely affected during such a short-period strain.

The adhesion of the top layer is nevertheless sufficient to ensure a safe handling of the cutting tools without damaging the top layer. A first use of the cutting tool, however, is immediately recognizable by a partial abrasion of the top layer. In such a case the top layer serves as a starting use indicator which responds to the first use of the cutting tool.

For a top layer, for example, titanium nitride layers, as well as oxidic (heteropolar) layers, such as $TiO_2$ are suitable. Likewise, other oxides, carbides or nitrides of metals of the fourth or fifth side group are suitable. Top layers having a metallic-crystalline structure are preferred. In contrast, the separating layer has, for example, no metallic-crystalline structure. This may be achieved by using, as the separating layer, an oxide layer of a side group metal, preferably of the fourth or fifth side group. Thin layers of, for example, about 0.1 μm $TiO_2$ layers or other CN layers which are extremely soft and have low frictional properties yield good results. Good results are also obtained with $MoS_2$ layers or extremely non-stoichiometrical layers. For example, extremely stressed layers may also limit the adhesion between the top layer and the wear-protection layer. Stressed TiN layers or also DLC (diamond-like carbon) layers may be used. The selection of a suitable separating layer for the application at hand is dictated by the feasibility of integrating it, possibly without any additional expenditure, in the PVD process for making the entire coating. The separating layer constitutes, to a certain measure, a "desired location of fracture" for any layer superposed thereon.

In the simplest case the wear-protection layer (metallic hard material layer) may have a single-layer structure. If required, a multi-layer structure may also be utilized.

The described coating may be manufactured in a PVD process without substantial expenditure, and the deposited top layer may be subsequently mechanically easily removed. In this manner the manufacture of multi-color cutting tools is feasible simply and rationally. By cutting tools there are meant in this context complete cutting tools, such as full hard metal drills, milling tools and the like, as well as merely cutting inserts, reversible cutting inserts, cutting bits and the like.

Figure 2:
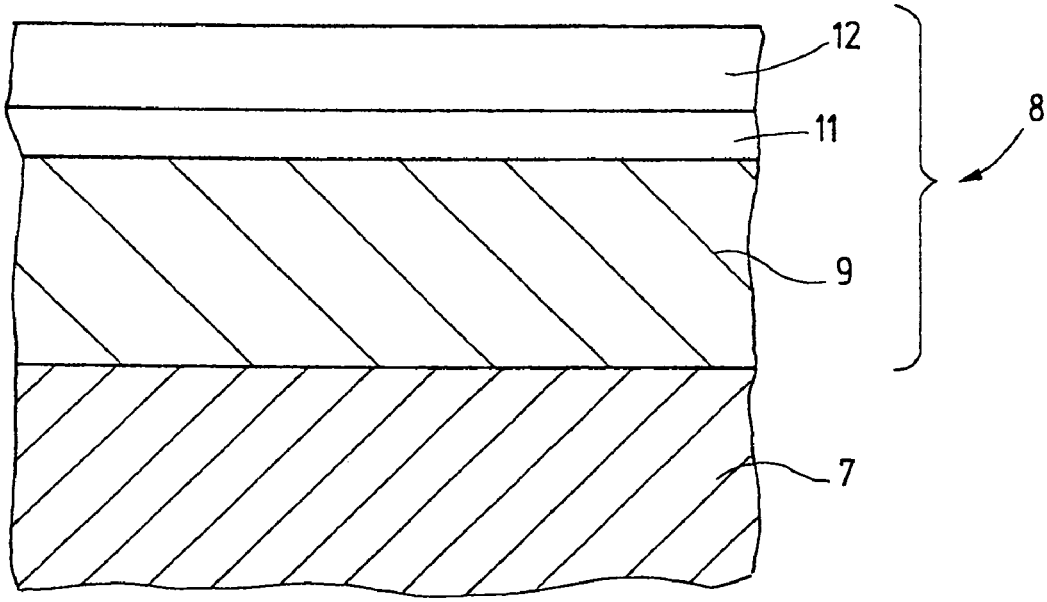
Figure 3:
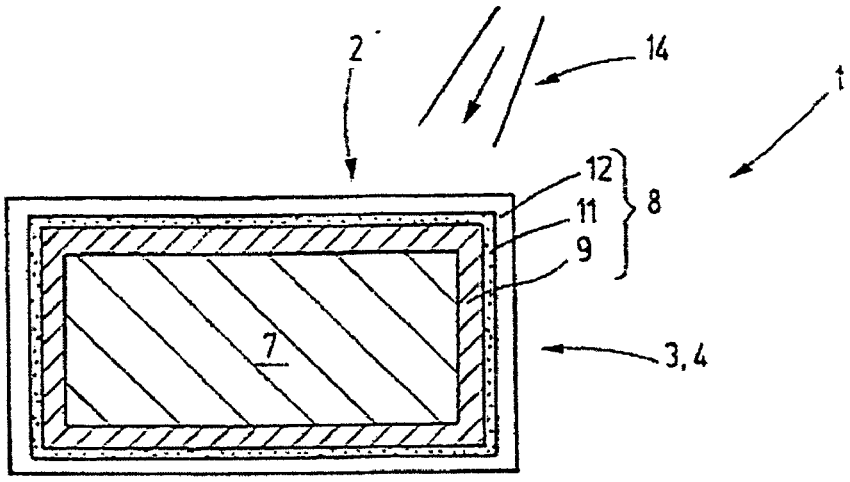
Figure 4:
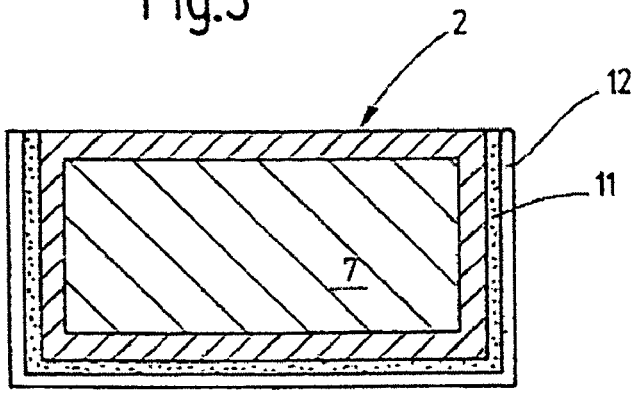
Figure 5:
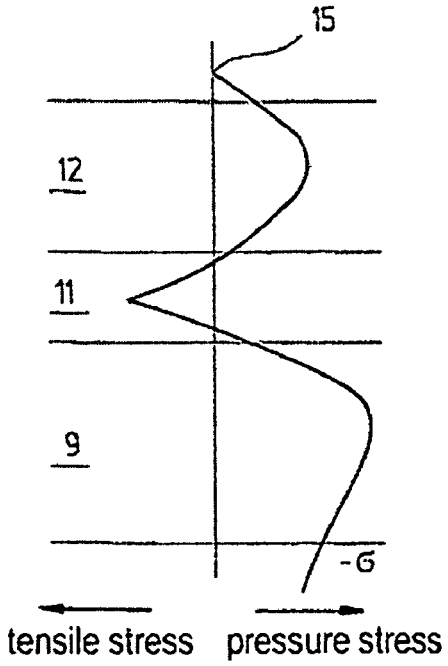

Further advantageous details of additional features of the invention are contained in the drawing, the description or the claims. In the drawing, which illustrates an embodiment of the invention, FIG. 1 is a schematic perspective view of a cutting tool according to the invention, FIG. 2 is a fragmentary section taken across the cutting tool according to FIG. 1, FIG. 3 is a schematic, cross-sectional, not-on-scale showing of a cutting tool after a continuous PVD coating process, FIG. 4 is a schematic cross-sectional view of the cutting tool according to FIG. 3, following a partial abrading of a top layer and the underlying separating layer and FIG. 5 is a diagram illustrating an exemplary stress curve relating to the stresses prevailing in the various layers.

FIG. 1 illustrates a cutting insert 1 as a cutting tool or at least a substantial portion thereof. The cutting insert 1 has a top surface which constitutes a rake surface 2, as well as side surfaces which constitute clearance surface 3, 4. This designation applies to a radial installation of the cutting insert 1. In case of a tangential or a lateral installation, the side surfaces serve as the rake surfaces, while the top surface serves as the clearance surface. Between the rake surface 2 and the clearance surfaces 3, 4 cutting edges 5, 6 are formed.

The cutting insert 1 is a hard metal cutting insert. FIG. 2 shows a greatly magnified fragmentary cross section of the cutting insert. As seen, the cutting insert 1 has a basic body 7, whose upper surface forms a substrate for a coating 8 provided on the cutting insert 1. The coating 8 is applied in a PVD process. As an inner layer which directly adjoins the substrate, a wear-protection layer 9 is provided which is a metallic hard material layer MH, such as a TiAlN (titanium aluminum nitride) layer having metallic properties. It adheres firmly to the basic body 7 which is a hard metal, such as cobalt-containing tungsten carbide. The thickness of the TiAlN layer may be set in accordance with the intended application. In the present embodiment its thickness is about 4 μm. The ratio between titanium and aluminum is 33:67.

To the wear-protection layer 9 a separating layer 11 is applied which interrupts the metallic adhesion bond to a superposed top layer 12. The top layer 12 too, is preferably a metallic-crystalline layer, such as a TiN layer, whose thickness is, for example, 0.2 μm. In such a case the top layer 12 is a purely decorative layer of golden color. Such a color is significantly different from the color of the differently colored wear-protection layer 9.

The separating layer 11 is, for example, a titanium dioxide ($TiO_2$) layer which may be selected to be relatively thin: a thickness of, for example, 0.1 μm suffices. This oxide layer has no metallic properties and thus limits the adhesion of the top layer 12 to the wear-protection layer 9. The described coating 8 may be made with one continuous process in one and the same reaction vessel of a PVD coating unit by sequentially depositing the wear-protection layer 9, the separating layer 11 and the top layer 12.

As described above, the separating layer 11 and the top layer 12 may be chemically and/or structurally different layers. It is, however, also feasible to combine them into a separating-and-top layer, whose particular property resides in the limited adhesion to the wear-protection layer 9. In such a case the separating layer 11 simultaneously constitutes the top layer.

The manufacture is as follows:

The basic body 7 is introduced into a suitable PVD coating unit in which first the wear-protection layer 9, then the separating layer 11 and thereafter the top layer 12 are precipitated on the basic body 7. The coating 8 obtained in this manner is first produced on all the exposed surfaces of the basic body 7, that is, at least on the rake surface 2 and on the clearance surfaces 3, 4. The cutting insert 1 is removed from the PVD reactor vessel in this condition.

Frequently two-color cutting inserts are desired which have on their rake surface 2 a color that is different from that on the clearance surfaces 3, 4. For making such a cutting insert, the top layer 12 is removed from the other surface to be differently colored, in this instance, from the rake surface 2. This may be done by a sandblasting jet 14, as indicated in FIG. 3. As sandblasting particles aluminum oxide (320 mesh size high-grade corundum) may be used. During a short period of application of, for example, 2 seconds, the top layer 12 as well as the separating layer 11 are removed from the rake surface 2 without visible residues, as shown in FIG. 4. The earlier-noted $TiO_2$ layer having a thickness of 0.1 μm, however, has such an adhesion and strength that the top layer 12 remains undamaged at locations which are not directly affected by the jet 14.

In further embodiments the cutting insert 1 may have other wear-protection layers 9 and other top layers 12. In each instance, however, the wear-protection layer 9 is a metallic hard material layer produced in the PVD process. Layers of a hard material without a metal structure, such as $Al_2O_3$, are not included in the metallic hard material layer of the wear-protection layer 9. As a top layer, the earlier-noted TiN layer, as well as any other metallic top layer, such as TiC layers, CrN layers, HfN layers and the like may find application. As a separating layer 11 any, preferably non-metallic layer may be used which limits the adhesion between the top layer 12 and the wear-protection layer 9. Apart from the $TiO_2$ layer identified in the previous embodiment, other oxidic layers may be used which may be precipitated in the PVD process and which have no metallic bond. Particularly oxides of metals of the fourth and fifth side groups may be utilized. Other, preponderantly covalent bonded layers, such as MCN layers may find application, where M designates an arbitrary metal, preferably a metal of the fourth or fifth side group. Other covalent bonded layers, such as $MoS_2$ layers (molybdenum sulfide) or carbon layers (DLC) may be used. It is, however, also contemplated to provide metallically bonded separating layers, such as TiN layers. For achieving a limitation of adhesion in the latter, they may be stressed to an extreme degree. A stressing may be achieved, for example, by a substantial deviation of the stoichiometrical relationship. In this connection, FIG. 5 illustrates the course of stress in the wear-protection layer 9, the separating layer 11 and the top layer 12 for the exemplary case, where a limitation of adhesion is obtained by an oppositely oriented stressing of the separating layer 11 with respect to the wear-protection layer 9 and the top layer 12. The stress prevailing in the coating is shown as a curve 15. Thus, the stresses in the wear-protection layer 9, the separating layer 11 and the top layer 12 are, for example, as follows:

- wear-protection layer 9—up to 2 GPa (Giga pascal=$10^9$ Pascal) pressure stress corresponding to −2 GPa (Giga pascal=$10^9$ Pascal),
- separating layer 11—approximately 0.8 GPa (Giga pascal=$10^9$ Pascal) tensile stress corresponding to 0.8 GPa (Giga pascal=$10^9$ Pascal), top layer 12—approximately 1 GPa (Giga pascal=$10^9$ Pascal) pressure stress corresponding to −1 GPa (Giga pascal=$10^9$ Pascal).

A coating, particularly for cutting tools, is presented which may be manufactured in a single PVD coating process allowing the making of two-color cutting tools in a simple manner. Between two metallic hard material layers of unlike color a separating layer 11 is provided which, like the other layers, is produced in the same PVD coating process. The separating layer 11 permits the abrasion of the top layer by sandblasting, brushing or the like in very short abrading periods.

The invention claimed is:

1. A coating for a cutting tool, comprising a wear-protection layer having a metallic-crystalline structure, a top layer, and a separating layer applied to at least one portion of the wear-protection layer and arranged between the wear-protection layer and the top layer, wherein the separating layer has a structure which is not metallic-crystalline and limits the adhesion of the top layer to the wear-protection layer, and wherein the separating layer (i) contains or is a chemical compound with a preponderantly covalent bond, (ii) is strongly non-stoichiometrically composed, or (iii) is a strongly stressed layer.

2. The coating as defined in claim 1, wherein the top layer has a color which perceptively differs from a color of the wear-protection layer.

3. The coating as defined in claim 1, wherein the top layer is a ZrC, CrC, ZrN, CrN, TiN, a TiC, a HfC or a HfN layer.

4. The coating as defined in claim 1, wherein the top layer has a metallic-crystalline structure.

5. The coating as defined in claim 1, wherein the separating layer is an oxide layer containing at least one metal from the $IV^{th}$ or $V^{th}$ group of the chemical periodic system of elements.

6. The coating as defined in claim 5, wherein the metal is an element of the $IV^{th}$ group.

7. The coating as defined in claim 6, wherein the metal is titanium or zirconium.

8. The coating as defined in claim 5, wherein the metal is an element of the $V^{th}$ group.

9. The coating as defined in claim 1, wherein the separating layer has an inner stress which significantly differs from an inner stress of the wear-protection layer and the top layer.

10. The coating as defined in claim 1, wherein the wear-protection layer is a TiAlN layer or a CrAlN layer.

11. The coating as defined in claim 1, wherein the wear-protection layer has a single-layer structure.

12. The coating as defined in claim 1, wherein the wear-protection layer has a multi-layer structure.

13. The coating as defined in claim 1, wherein the top layer is a decorative layer.

14. The coating as defined in claim 1, wherein the wear protection layer is predominately in compression, the separating layer is predominately in tension, and the top layer is predominately in compression.

15. The coating as defined in claim 1, wherein the separating layer disrupts or disturbs a metallic-crystalline bond between the top layer and the wear-protection layer.

16. A cutting tool comprising:

a basic body made of a hard material; and a coating which is applied to the basic body, the coating comprising a metallic hard material layer as a wear-protection layer, a top layer, and a separating layer applied to at least one portion of the wear-protection layer and arranged between the wear-protection layer and the top layer, wherein the separating layer has a structure which is not metallic-crystalline, and wherein the separating layer (i) contains or is a chemical compound with a preponderantly covalent bond, (ii) is strongly non-stoichiometrically composed, or (iii) is a strongly stressed layer.

17. A cutting tool as defined in claim 16, wherein the wear-protection layer is provided at least on a clearance surface and at least on a rake surface, while the top layer does not cover or only partially covers the clearance surface and/or the rake surface.

18. A method of making a cutting tool, comprising:

first applying in a PVD coating process a coating to a basic body in a layer sequence including a metallic hard material layer as a wear-protection layer, a separating layer applied at least to one portion of the wear-protection layer, and a top layer on the separating layer, and subsequently removing the top layer from selected upper surface portions by a mechanical abrading process, wherein the separating layer has a structure which is not metallic-crystalline, wherein the wear-protection layer has a metallic-crystalline structure, and wherein the separating layer (i) contains or is a chemical compound with a preponderantly covalent bond, (ii) is strongly non-stoichiometrically composed, or (iii) is a strongly stressed layer.

19. The method as defined in claim 18, wherein the top layer is removed by a sandblasting process.

20. The method as defined in claim 18, wherein all the layers of the coating are applied in a single PVD process.

* * * * *